US005425341A

United States Patent [19]

Connolly et al.

[11] Patent Number: 5,425,341

[45] Date of Patent: Jun. 20, 1995

[54] FUEL INJECTION WITH PULSE RATE SHAPING CAM

[75] Inventors: Michael C. Connolly, Royal Oak; David A. Richeson, Livonia; Nshan Hamparian, Troy, all of Mich.

[73] Assignee: General Motors Corporation, Detroit, Mich.

[21] Appl. No.: 275,563

[22] Filed: Jul. 15, 1994

[51] Int. Cl.[6] ..... F02M 41/00

[52] U.S. Cl. ..... 123/450

[58] Field of Search ..... 123/450; 417/462

[56] References Cited

U.S. PATENT DOCUMENTS

| | | | |
|---|---|---|---|
| 3,433,159 | 3/1969 | Kemp | 123/450 |
| 4,377,139 | 3/1983 | Jarrett et al. | 123/358 |
| 4,468,179 | 8/1984 | Fenne et al. | 123/450 |
| 4,470,760 | 9/1984 | Jerrett et al. | 123/450 |
| 4,493,621 | 1/1985 | Fenne et al. | 123/450 |
| 4,757,795 | 7/1988 | Kelly | 123/506 |
| 5,094,216 | 3/1992 | Miyaki et al. | 123/506 |
| 5,103,792 | 4/1992 | Winkler et al. | 123/506 |

*Primary Examiner*—Henry C. Yuen

*Assistant Examiner*—Thomas N. Moulis

*Attorney, Agent, or Firm*—Karl F. Barr, Jr.

[57] ABSTRACT

A fuel distributing pump for a multi-cylinders, internal combustion engine having a sinuously profiled cam member providing a plurality of discrete compound cam pumping stations, each comprising primary and auxiliary cams serially arranged and interconnected by an intermediate cam segment which cooperate with pumping plungers of a pump rotor to shape and vary the pulse waves of fuel delivered to the combustion chambers for varying engine operations. For low horsepower requirements, such as idle and light loads, only the primary cam with fast initial pumping rate and following low rate camming ramps or surfaces are utilized to shape the pulse wave with a fast beginning and a graduated end of injection for even and progressive fuel burn for reducing smoke and engine noise. For higher engine loads, the primary cam, the interconnecting cam segment and a large part of the auxiliary cam are employed for a fast beginning and end of injection for shaping and increasing the quantities of fuel in the pulse waves pumped for effective high horsepower operation with cleaner exhaust.

7 Claims, 4 Drawing Sheets

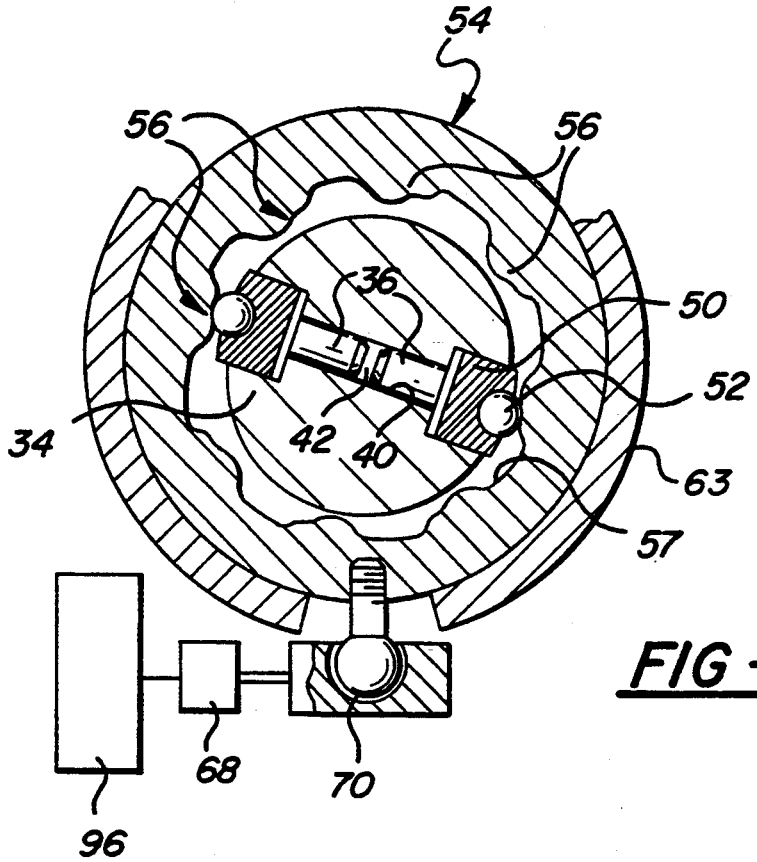
FIG-2
FIG-3
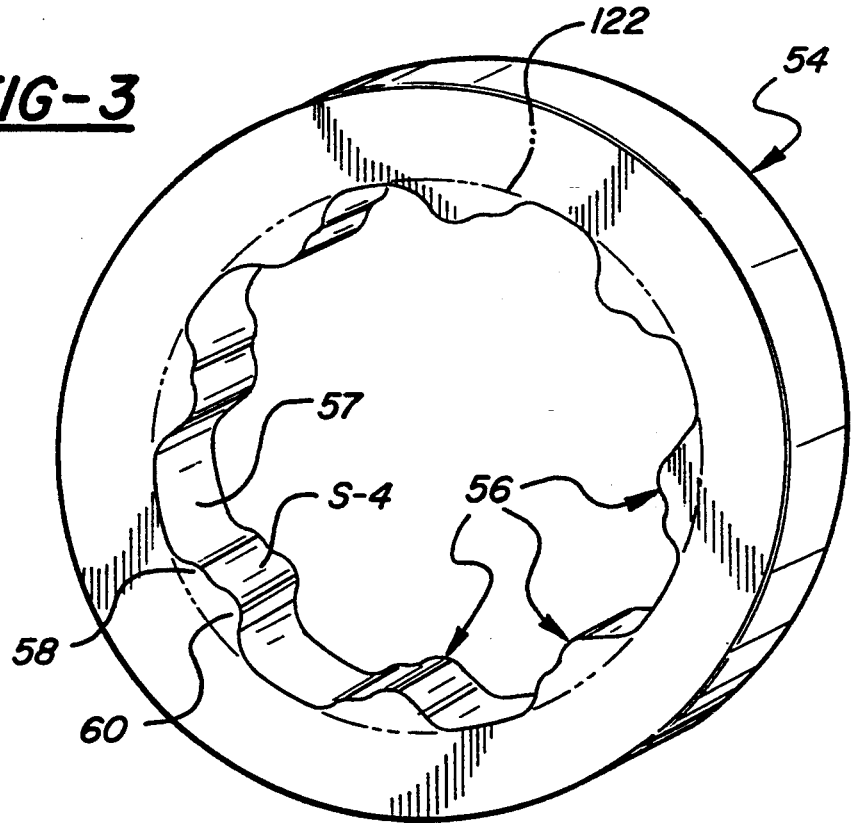

S-7
S-6
56
H
I
S-5
S-4
S-3
S-2
G
F
60
D
E
C
S-1
58
B
C
S-2
D
S-3
S-5
G
S-6
H
T-1
S-4
T-5
T-2
T-4
E
F
T-3
58
PUMPING RATE (mm3/DEGREE)
0
1
2
3
4
5
6
0 3 6 9 12 15 18 21 24 27 30 33 34
DEGREE
W1
W2
W3
W4
W5
ANGLE

FUEL INJECTION WITH PULSE RATE SHAPING CAM

BACKGROUND OF THE INVENTION

This invention relates to pumping cams and methods for injecting fuel into the combustion chambers of internal combustion engines. In one aspect, this invention is directed to a new and improved cam which is sinuously profiled with arcuately spaced compound cam pumping stations to produce pulse waves of controlled quantities of fuel with a fast initial rate and a subsequent soft end of injection for improved burns having reduced particulate emission for low engine loads, and further, with a fast initial rate and a fast end of injection with increased fuel supply for engine starting and high horse power demands. Another aspect of this invention is directed to a new and improved method of fuel injection with a compound cam that shapes the profiles of pulses delivered to the engine combustion chambers.

Fuel distributor pumps have employed circular cams to inject pulses of fuel into the combustion chambers of internal combustion engines. In diesel engine application in which ignition results from high compression of the air-fuel mixture, the shape (profile and quantity) of the pulse waves of fuel injected into the combustion chambers is of great importance for improved burns over a wide range of engine loads. By varying the rate of injection for various engine loads, it is possible to obtain improved fuel economy with reduction in noise, particulate emissions and Nox.

DESCRIPTION OF PRIOR ART

Various cam designs have been employed to provide improved fuel injection performance and improved performance of internal combustion engines. Generally, with such cams, pumping begins at the beginning of the pumping cam surface and may be terminated at points on the surface generally at or past the outermost end thereof. Such prior cams are most suitable for light loads including idle and provide the desired soft end of injection for even burns for reduced noise and reduce particulate emissions. However, by using the end of the cam for light load application, there is insufficient cam surface left to supply the quantities of fuel needed for good starting and high load operations. By increasing the base circle of the cam to provide for additional fuel pumping, the desired noise and particulate control for light loads was unfortunately eliminated. Moreover, while such designs increased the fueling period for high load operation, the cam extension was to a point where NOx and particulates in the exhaust gases was objectionable.

In prior application, Ser. No. 08/022,204, filed Feb. 25, 1993, for "Control Fuel Injection Rate for Optimized Diesel Engine Performance" assigned to the assignee of this invention, and hereby incorporated by reference, varying portions of the cam pumping surfaces are employed to provide for optimized engine performance over a wide range of engine loads. While this prior design advantageously employed a standard cam, the injection pumping rate was determined by electronic controls that selected various parts of the cam for start of pumping and for spill to inject and variably shape the pulse wave of fuel for optimized performance over the varying engine loads from idle to wide open throttle.

BRIEF DESCRIPTION OF THE INVENTION

The present invention is drawn to a new and improved fuel pumping cam with sinuous pumping surfaces provided by arcuately spaced compound cam pumping stations having injection rates that vary to shape and optimize fuel pulses pumped to the combustion chambers of an internal combustion engine for different loads to reduce noise, exhaust particulate and NOx.

In the preferred embodiment of this invention, each station comprises a compound cam having a primary cam with a fast initial pumping rate cam surface followed by a low rate cam surface to shape the injection pulses for idle and other low load operations. This rate profiling for low torque operation results in important reductions of combustion noise and exhaust particulate.

In addition to the primary cam, each station comprises a following auxiliary cam with a cam surface that has a fast initial rate and a following low rate cam surface so that the primary and auxiliary cams can be cooperatively used to extend and shape the pulse with a fast beginning and a fast end of injection and with increased volumes of fuel to meet starting requirements and high power demands. With such profiles, there will be materially reduced NOx in the exhaust.

In other embodiments of this invention, the compound cam profiles can be reversed or otherwise changed to optimize operation of other engines, a two stroke engine versus a four stroke, for example. Low power demand may require termination on a high rate cam surface for fast end of injection. A soft rate end of injection as provided by a low rate part of the compound cam may be required to optimize engine operation on high power demands.

In any event, the compound pumping cam of this invention can be designed as in the preferred embodiments to be readily used in commercially available fuel distributor pumps to replace standard cams therein so that costs are minimized. Furthermore, with pumping starting at the beginning of the compound cam of this invention, controls can be simplified.

A feature, object and advantage of this invention is to provide a new and improved pumping cam member for a fuel distribution pump for a multi-cylindered internal combustion engine having spaced and discrete pumping stations, each comprising a compound cam with (1) a primary cam part having cam surfaces for pumping fuel into the combustion chambers of the engine so that the injection of fuel pulses can be terminated thereon to rate shape the end the fuel pulse for optimizing low power engine operation with reduced smoke and combustion noise, and (2) an auxiliary cam part that follows the primary cam and cooperates therewith to extend the injection period and provide an additional cam surface for rate shaping the pulse waves and for increasing the fuel supplied to the combustion chambers to meet higher engine power requirements and to further provide for cleaner engine exhaust.

Another feature, object and advantage of this invention is to provide a new and improved pumping cam member for a fuel distribution pump for a multi-cylindered internal combustion engine having spaced and discrete compound cam pumping stations, each comprising a compound cam having (1) a primary cam part with an initial cam surface for pumping fuel at a fast rate into the combustion chambers and having a following cam surface with a lower pumping rate so that the injection of fuel pulses can be terminated thereon to rate shape the end the fuel pulse for a long end of injection for lower power requirements, and (2) an auxiliary fast rate cam part that follows the low rate cam surface that cooperates with the primary cam to extend the fast injection rate and provide a cam surface for rate shaping the pulse waves with a sharp end of injection for increasing the fuel supplied to the combustion chambers to meet higher power requirements and with cleaner exhaust.

Another object of this invention is to provide a new and improved compound cam for a fuel distribution pump comprising a primary cam with a high pumping rate and a following slower rate so that the pumped waves of fuel have a rapid start and a progressively diminishing and gradual end of injection for even and smooth burns for reducing engine noise and smoke under light load conditions, and further, compressing an auxiliary cam arcuately spaced from said primary cam and cooperating therewith so that the pumped waves of fuel using both cams have a sharp beginning and end of injection and are profiled to provide varying large fuel volumes for varying high power engine operations.

Another feature and object of this invention is to provide a new and improved method of shaping and pumping varying quantities of fuel pulses into the combustion chambers of an internal combustion engine with a compound pumping cam having at least primary and auxiliary major pumping cams spaced and operatively linked with respect to one another by a pumping ramp and profiled so that the combustion chambers are supplied with rate shaped pulse waves of fuel by the primary cam with a rapid start of injection and a gradual end of injection for engine idle and low load operations, and in which the primary and auxiliary cams and the linking pumping ramp are sequently used to pump larger quantities of fuel into the chambers in larger volume rate shaped pulse waves each having a rapid start and end of injection for engine starting and high load operations.

These and other features, objects and advantages of this invention will become more apparent from the following detailed description and drawings in which:

DESCRIPTION OF THE DRAWINGS

FIG. 2 is a cross-section view taken generally along sight lines 2—2 of FIG. 1;

FIG. 3 is a pictorial view of the pumping cam of the fuel distributor pump of FIG. 1;

DETAILED DESCRIPTION OF THE DRAWINGS

Figure 1:
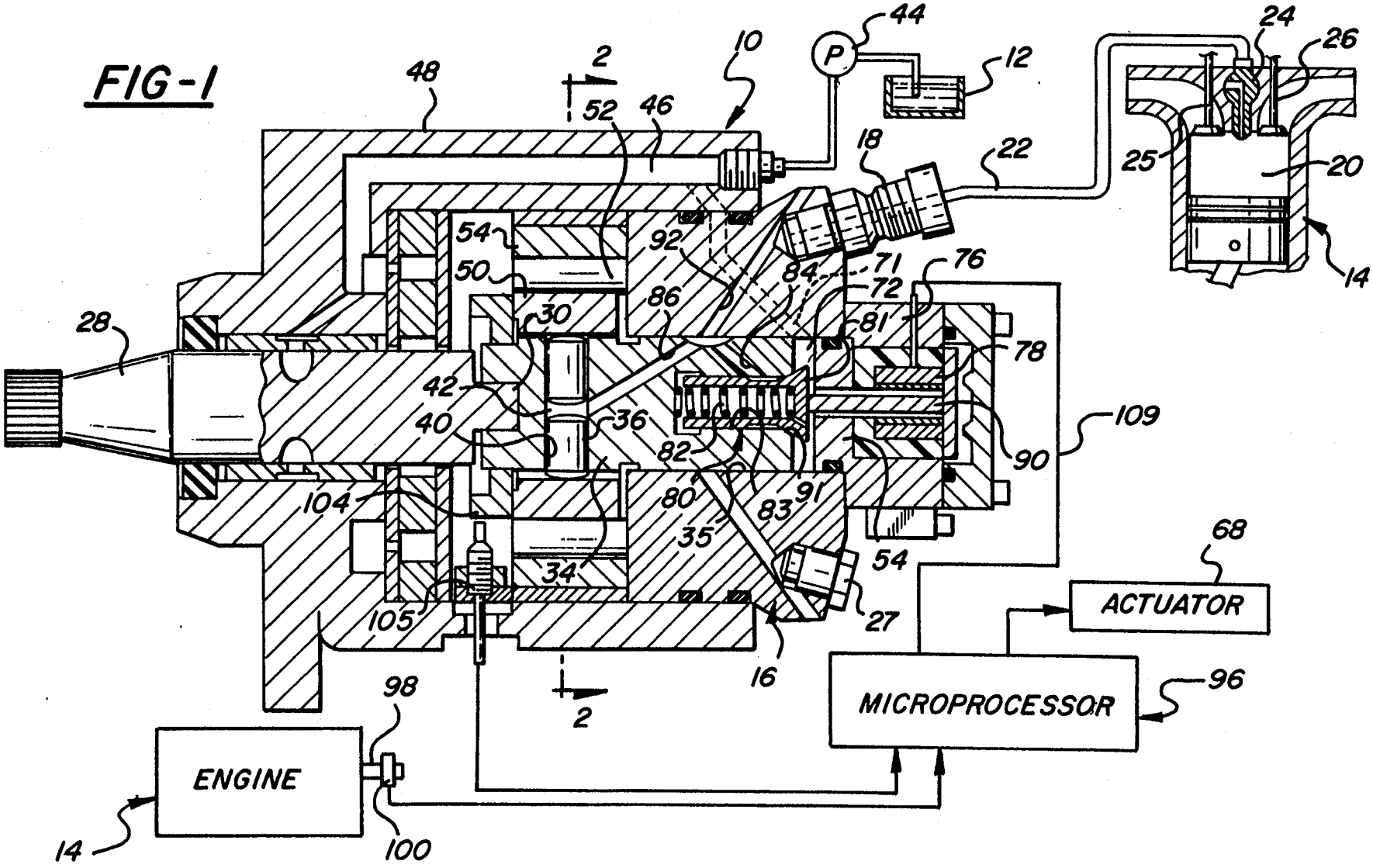
FIG. 1 is a diagrammatic sectional view of a fuel distributor pump for pumping pulse waves of fuel to an internal combustion engine.

The present invention can be employed with various fuel distribution systems, including the rotary distribution pump 10 of FIG. 1 for pumping and distributing pressure waves or pulses of liquid fuel supplied from a fuel tank 12 to the combustion chambers of an internal combustion engine 14. The pump 10 has a head assembly 16 with discharge fittings, such as 18, for feeding fuel pulses to the engine combustion chambers such as chamber 20 through a high pressure line 22 and fuel injector 24. The injector has a conventional spring loaded needle valve that is opened by the pressure of the pulses of fuel delivered by the pump at the appropriate time in the firing cycle. Air is drawn into combustion chamber through inlet valve 25, and after combustion, the gasses formed during ignition are expelled through open exhaust valve 26.

Other fuel discharge fittings, such as fitting 27 which is only partially shown, are arranged to feed fuel to other injectors and associated combustion chambers in the engine through similar injector lines and injectors not illustrated.

The distribution pump 10 has an elongated cylindrical drive shaft 28 adapted to be rotatably driven by an output of the engine 14. The inboard end of the drive shaft 28 has an axially extending polygonal drive key 30 that drivingly fits into a mating centralized socket formed in the longitudinal axis of a cylindrical rotor 34 that is rotatably mounted in a cylindrical bore 35 in the head assembly 16 of pump 10.

The rotor 34 has pumping plungers 36 mounted for reciprocating linear stroking movement in a bore 40 formed as a diameter in the rotor 34 which provides an expandable and contractible fuel receiving and pumping chamber 42 that is supplied with fuel by a transfer pump 44 that pumps fuel from the tank 12 through a fuel passage 46 in the housing 48 of the distributor pump 10.

The outer end of plungers 36 contact shoes 50 which have a U-shaped cross section to accommodate and carry cylindrical rollers 52 that engage the internal surface of annular cam member 54 best illustrated in FIGS. 2 and 3. Cam member 54 has a plurality of internal compound cams 56 providing fixed pumping stations arcuately spaced by dwells at equal intervals from one another to form a sinuous annular internal surface 57. Each compound cam 56 has a primary pumping cam 58 and an adjacent auxiliary pumping cam 60 connected by a low slope intermediate segment 62.

The primary and auxiliary pumping cams 58 and 60 of the compound cam 56 of the preferred embodiment are not identical in shape and the primary high lift pumping cam 58 has a smaller base circle than the auxiliary high lift pumping cam 60. The primary pumping cam of each compound cam 56 functions to inject and shape fuel pulses to the combustion chambers for low load operations while the auxiliary cam cooperates with the associated primary cam to provide increased quantities of fuel pulsed to the combustion chambers for high load operations.

Figure 4:
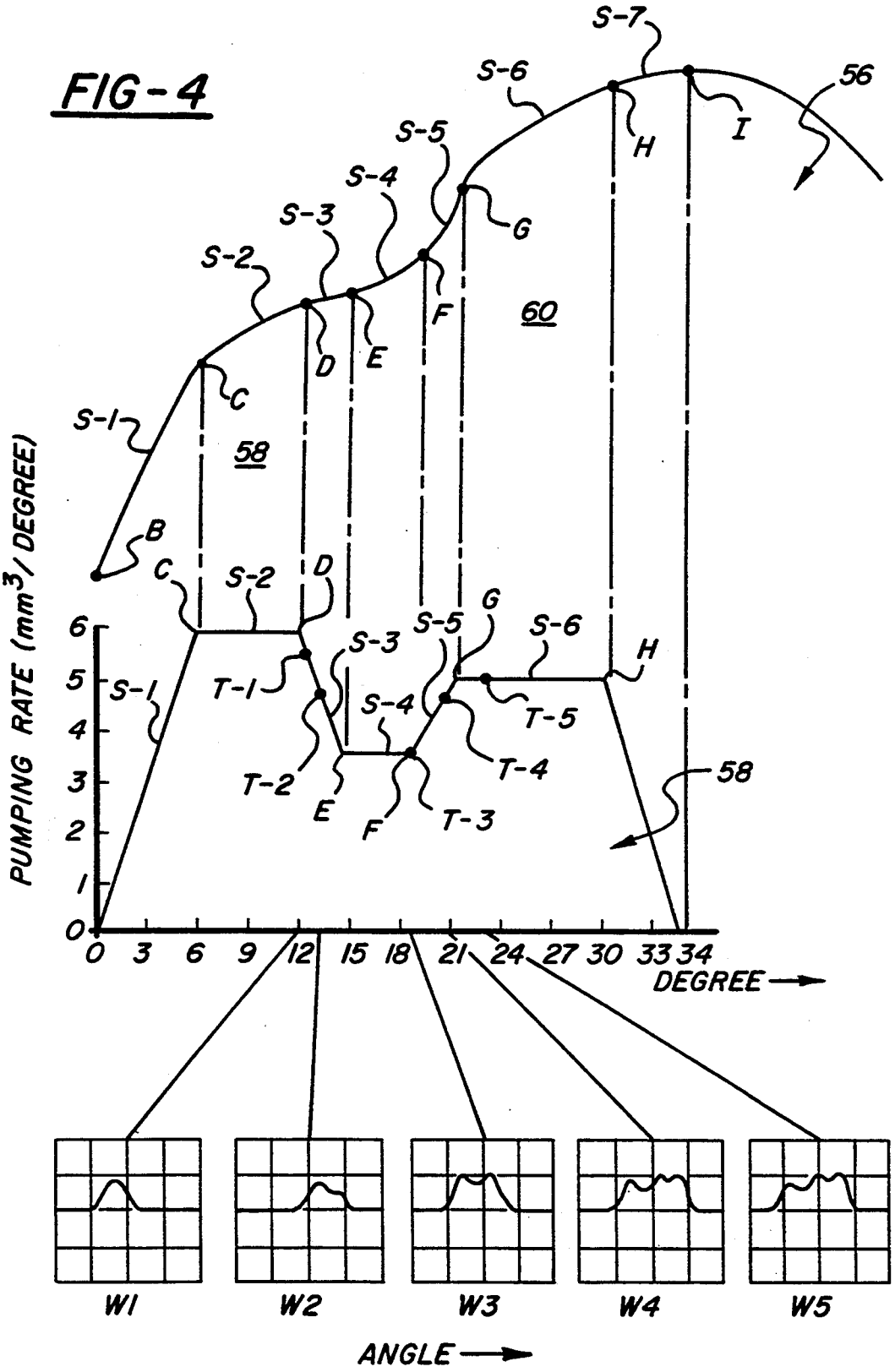
FIG. 4 is a diagram of one preferred embodiment of the compound pumping cam, the corresponding pumping rate profile thereof and the profiles of pressure waves varying with cam angle.
Figure 5:
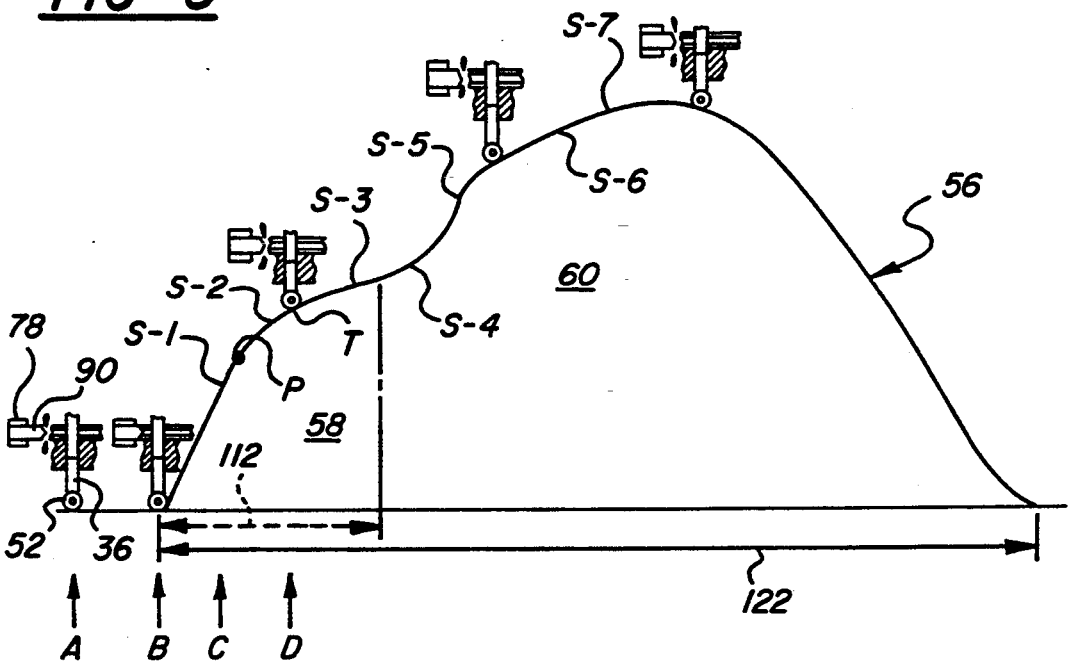
FIG. 5 is a pictorial diagram representing idle light load, low-speed engine operations using this invention.
Figure 6:
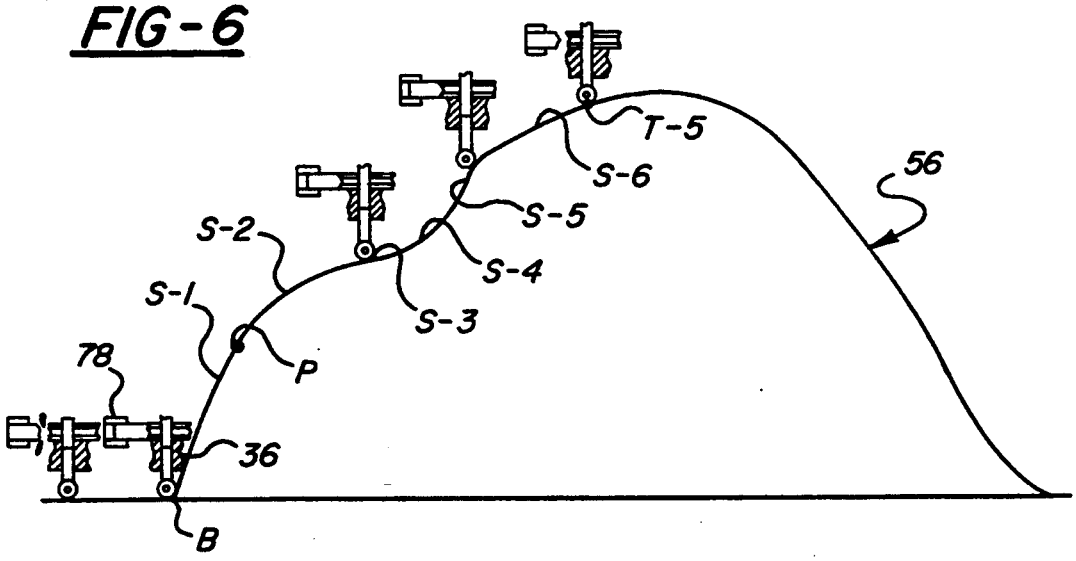
FIG. 6 is a pictorial diagram similar to the diagram of FIG. 5 representing large load, high speed and starting operations.

FIGS. 4–6 best show the profile of one of the preferred embodiments of the compound cam 56 as provided by interconnected primary and auxiliary cams 58 and 60, respectively. The primary cam 58 starts at point B at the end of a dwell between arcuately adjacent pumping stations. From point B, the pumping surface S-1 ramps at a sharp rate to point C. From point C to point D the pumping surface S-2 is defined and this surface has a lower slope and pumping rate as compared to surface S-1 to simulate the tip of a conventional pumping cam. The following pumping surfaces S-3 extending from point D to E has a further decreasing slope to simulate the back side of a conventional cam and in effect provides the end portion of the primary cam 58.

Connecting the primary cam to the auxiliary cam 60 is a transitional low slope pumping ramp or surface S-4 starting at point E and ending at point F. The auxiliary pumping cam 60 follows the transition ramp and begins at point F and rises sharply at a high rate to point G providing a high rate pumping surface S-5. From point G to point H the rate sharply decreases and the pumping surface S-6 thereof pumps at low rate as compared to surface S-5, but this rate of injection is sufficiently high to provide a quick end of injection.

From point H to point I, surface S-7 is provided to define a further reduced rate section preceding the back side of the auxiliary cam surface. Surface S-7 can be used for fuel spill points if softer ends of injection are desired. In the preferred embodiment, the slopes of ramps S-2, S-4 and S-6 are generally parallel, but non-parallel slopes can alternately be used for changing pulse wave shapes for different engine operations, if desired.

The annular cam member 54 can be turned in a cam support ring 63 in housing 66 by operation of a stepper motor 68 drivingly connected to the cam by a suitable linkage here illustrated with a ball and socket connection 70. The stepper motor 68 provides for the rotation of the cam in either direction slightly to vary the delivery timing. This advance mechanism advances or retards start of fuel delivery in response to engine speed changes.

The fuel passage 46 in the distribution pump housing 48 communicates by an inlet passage 71 in the head assembly of the distribution pump to an end chamber 72 formed between the end of the rotor 34 and the reduced diameter cylindrical neck 74 of a housing 76 of a solenoid 78 secured to the end of the head assembly 16.

A spill valve 80 having a conical head 81 and a cylindrical stem is mounted in an axial bore 83 formed in the outboard end of the rotor 34. The stem of this valve is hollow and houses a helical spring 82 that shifts the valve 80 to an open position when the solenoid is not energized or "off." When this occurs on an intake stroke, fuel can be supplied to the pumping chamber 42 through paired diagonal fuel feed passages 84, 86 formed in the rotor.

When the spill valve 80 is subsequently shifted to a closed position by the linear movement of the solenoid, armature 90 moves inwardly in response to solenoid energization. When this occurs, the conical head 81 of the spill valve is forced by the armature into sealing engagement with its conical seat 91 formed in the end of the rotor 34 so that passage 84 is sealed. Under these conditions, the fuel spill valve is closed so that the plungers stroking inwardly by selected surfaces S-1 through S-7 of the compound cams 56 pump high pressure waves or pulses of fuel through passage 86 and aligned fuel injection passages, such as passage 92, as illustrated in FIG. 1.

Passage 92 feeds the high pressure fuel pulse wave into fuel discharge fitting 18 so that a pressure wave of fuel is injected into the injector 24, effecting injector needle valve lift and then into combustion chamber 20. After the injected fuel and the intake air are fully compressed by the piston at the top dead center, the fuel and air mixture ignites to power stroke the piston to turn the engine crank shaft. Gases formed during ignition are expelled through the exhaust valve 26 on upward exhaust stroke of the piston to complete the cycle.

As the rotor 34 rotates in the head assembly, the feed passages 86 will be sequentially aligned with other fuel injection passages leading to the different discharge fittings, and through these fittings the shaped pressure waves will be sequentially fed into associated combustion chambers of the engine 14. The end of injection of each pulse or pressure wave results from deenergization of the solenoid and the accompanying opening of the spill valve so that the fuel will be pumped or "spilled" into the chamber 42 and thereby back to the fluid supply system instead of the fuel injectors.

Electronic controls for this distributor pump include a microprocessor 96 that is programmed with various stations for solenoid switching, such as spill points on the compound cam, which vary in accordance with the engine loads for the spill of the fuel to end the injection event. With the event ending at varying points or stations such as on the reduced rate surface or ramp S-3 of the primary cam for low torque engine operation, there will be a controlled termination of the pumping event so that the injected pulse wave of fuel fed to the combustion chambers will be tailored for even burn with accompanying reduction of exhaust particulate. This even burn further results in the elimination or the substantial reduction of engine knock. In view of the fact that there is only a low load demand, the "spill" continues for the rest of plunger travel across the compound cam since armature 90 of the solenoid valve remains in its retracted position. Accordingly, while the pumping plungers traverse the rest of the primary and all of the auxiliary cam, no fuel will be pumped to the combustion chambers.

Such is not the case for varying high load engine operations. In viewing FIG. 6, the plunger 36 will traverse the dwell portion of the cam and then at point B, the start of the primary cam 58, the programmed microprocessor effects the energization of solenoid 78 and the resultant closure of the spill valve. Since internal spill is reduced, the system fills with fuel at a lower point on ramp or surface S-1 as compared to the operation of FIG. 5 before there is actual pumping into the combustion chambers. Pumping into the combustion chambers can start at different points on the upwardly inclined initial pumping ramp S-1 of the compound cam depending mainly on engine load and speed.

From the above, it will be appreciated that this invention importantly recognizes the fact that there is less internal spill with increasing engine speed so that at low speeds the actual pumping to the combustion chambers will be further on the pumping ramp S-1 of the primary cam as compared to high speed operation.

In any event, for high torques, the spill valve 80 remains closed throughout the entire base circle of the primary cam, the lower rate transitional ramp or surface S-4 between the primary and auxiliary cams and a large portion of the auxiliary cam. Accordingly, the pulses of fuel pumping will be rate shaped with a terminal fast end of injection preferably on ramp S-6 near the maximum lift of the auxiliary cam. In such injection, a large part of the base circle 112 of the compound cam is employed to provide the increased quantities of fuel needed for high load operation. With fast end of injection for high load operation there is improved combustion of the fuel so that NOx is reduced in the exhaust. With a large part of the compound cam being used, the quantities of fuel required for high loads are obtained without dragging out the combustion process as would be the case with the extension or enlargement of a conventional pumping cam.

The microprocessor is fed with input data such as the angular speed of engine output shaft 98 from pickup 100. The position of the pumping plungers relative to their position on the cam member including positions on the primary and auxiliary pumping cams are provided by sensor 105 mounted on the pump housing which cooperates with a toothed wheel secured to rotor 34. The microprocessor being supplied with such information can send its commands pulses to the solenoid 78 through circuitry to effect solenoid operation. For example, the solenoid can be de-energized at given points on the profile of the compound cam pumping station to effect fuel "spill" to terminate injection of the pulse wave to the combustion chamber.

The rotary cam as seen in FIGS. 2 and 3 has eight compound cam pumping stations each having a primary pumping cam 58 and an auxiliary pumping cam 60 linked together by the intermediate connector or transitional segment S-4. These stations are operative to pump fuel into the eight combustion chambers of the cylinders of an engine associated with this invention. The pumping cams 58, 60 are serially engaged by the pumping plungers operatively mounted in the rotor which are stroked thereby to pump the high pressure waves or pulses of fuel distributed to the eight combustion chambers.

In the preferred embodiment, the primary cam 58 is engineered to rate profile the injected pulse wave for low load operations with fast beginning and soft end of injection for improved and even fuel burns so that there is no sudden explosion in the combustion chamber and accordingly no engine "knock." Furthermore, with this improved burn there is low particulate emissions.

Such operation is shown in FIG. 5 in which fuel pumping starts at point B, the beginning of the primary cam 58, and after the pump and delivery lines are charged with fuel, actual delivery to the injector will begin at a point on the inclined pumping surface or camming ramp S-1. When the microprocessor 96 determines that a sufficient quantity in a pulse of fuel has been pumped, it deenergizes the solenoid so that the spill valve opens to effect "spill" and pulse wave termination.

This is diagrammatically illustrated in FIG. 5. In that Figure the pumping plunger 36 is moving across one of the compound cam pumping stations having a base circle 112. At point A, the plunger is on a dwell portion of the cam member 54 and the spill valve is opened so that no fuel can be pumped to the combustion chamber. At point B, the microprocessor knowing the position of the pumping plungers effects energization of the solenoid and closure of the spill valve. The pumping plunger is accordingly conditioned to pump fuel and charge the pump and line. After this occurs and at some point on the primary cam, point "P" for example, a pulse wave of fuel will start to be pumped into the combustion chamber 20 with a rapidly increasing beginning of injection as determined by the pumping rate or output of the camming ramp S-1.

The microprocessor will effect spill at a selected pumping plunger position on low slope section S-2 of the primary pumping cam, point "T" for example, where the pumping rate has slowed down to effectively simulate the pumping plunger running past or over the end of a conventional pumping cam, such as disclosed in application Ser. No. 022,204 referenced above. Under such conditions the pulse wave will be profiled with a slow end of injection. The remainder of the cam station will be traversed but the solenoid remains off for fuel "spill" so that there will be no further fuel pumping into the combustion chambers during this event.

When the auxiliary cam 60 is employed with the primary cam 58 as in FIG. 6, a large percentage of the compound cam 56 with base circle 122 is employed so that there is sufficient fuel delivery for engine starting and for high torque demand situations such as hill climbing or wide open throttle operations. Pumping begins at point B with injection at point P on the primary cam and spill is initiated at point T-1 on surface S-6 of the auxiliary cam 60 for the fast end of injection.

FIG. 4 includes a profile of the compound cam 56, a corresponding diagram P-1 of the pumping or output profile of the compound cam of the preferred embodiment of this invention, and corresponding illustrative profiles W-1 through W-6 of the fuel pressure waves as obtained by using the different portions of the compound cam. The ordinate or pumping rate output of profile P-1 represents the pumping rate in cubic millimeters per degree while the abscissa represents degrees on the base circle 122 of the compound cam. At spill point T-1 on the profile of the primary cam, about 12.2 pumping degrees have been traversed and 10 $mm^3$ have been injected with a wave profile shown in plot W1. This profile illustrates the desired fast beginning and the slow end of injection needed for the controlled burn in the combustion chambers so that there is reduced noise and reduced particulate emissions of particulates from unburned hydrocarbons.

In the event that the speeds are slightly higher, more fuel is needed so the pumping rate could be increased for spill at point T-2, about 13 degrees of the primary cam for delivery of 15 cubic millimeters of fuel to the combustion chamber. The profile of such pulses appears in plot W2 in which the end of injection has been extended so that the burn is still controlled but is not as tapered as in plot W1, however, more fuel as represented by the area under the curve and consequently more energy is available for the engine operation.

For 20 cubic millimeters of fuel, the pump is spilled at point T-3 on the cam to produce a profile, such as in plot W3, in which the end of injection is not as slow as in plot W1, however, sufficient degrees of pumping are employed to provide a larger quantity of fuel needed for still higher speed and load operation.

When the spill is terminated at point T-4, 20 pumping degrees on the compound cam profile, 30 cubic millimeters of fuel are delivered to provide the increased amounts of fuel for high load engine operation.

At points T-5 an even higher amount of fuel is needed. Accordingly, the auxiliary cam has provided the increasing quantities of fuel needed for this operation. The profiles are shown in plots W4, W5, with rapid end of injection for different high load operations in which increased fuel is needed for high horsepower operations.

At idle only the primary cam is employed, whereas in engine starting and for high torque operations, a large portion of the entire profile is used in which both primary and auxiliary cams are employed.

The low slope portions, such as S-3, S-4 for example, of the compound cam 60 do not detract from cam performance since there is reduced leakage with increasing speeds and the amounts of fuel are increased by the upwardly inclined positive ramps including portions S-3, S-4 to provide for the increased pumping of fuel for high torque operation.

While a preferred embodiment of the invention has been shown and described, other embodiments will now become apparent to those skilled in the art. For example, the compound cam of this invention could be readily employed to operate and directly control an associated fuel injector to tailor pulse waves of fuel in accordance with a wide range of engine loads or to replace the cams of a variable discharge high pressure pump for a common rail fuel delivery system such as disclosed in U.S. Pat. No. 5,094,216. Accordingly, this invention is not to be limited to that which is shown and described but by the following claims.

What is claimed is:

1. A fuel injection cam with a dwell and a rate shaping pumping station comprising a compound cam for contacting and displacing a member for the injection of shaped pulses of fuel into a combustion chamber of an internal combustion engine, said compound cam including a primary cam initially rising from a point on said dwell to a first point to establish a first pumping section on which a pulse of fuel can be started for establishing an initial fast beginning rate of fuel injection, said primary cam having an intermediate section with a lower pumping rate than said first pumping section and further having an ending section having a pumping rate less than the pumping rate of said intermediate section to provide points for establishing a soft rate end of injection for low load engine operations, said compound cam further including an auxiliary cam operatively connected to the primary cam to extend the injected pulses of fuel into the combustion chamber for high load engine operation.

2. The fuel injection cam of claim 1, and further including a transitional low stroke ramp between said primary and auxiliary cam for contacting and displacing said member for the injection of shaped fuel pulses for high load engine operation.

3. A compound pumping cam for stroking the pumping plungers of a fuel injector pump to pump and profiling pulse waves of fuel into the combustion chambers of an internal combustion engine comprising a dwell portion, a primary cam having first cam surface inclined in a first direction from a point on a base circle of said pumping cam to provide a fast beginning of injection of said pulse waves of fuel, said primary cam having a second cam surface that has a pumping rate lower than the rate of said first cam surface and having a subsequent continuing cam surface that has a pumping rate to provide a cam surface on which injections can be terminated to profile the pulse wave with a graduated and slow end of injection for a range of low torque demands, said pumping cam further comprising an auxiliary cam and a transitional cam surface operatively connecting said primary and auxiliary cams, said auxiliary cam having a high rate pumping surface rapidly rising from the end of said transitional cam surface to increase the rate of fuel injection to enlarge the profile of the pulse waves so that said pulse waves contain sufficient volumes of fuel for high torque demands and are profiled with fast beginnings and end of injection for cleaner exhaust gases.

4. A compound cam cooperating with cam followers for profiling the pulse waves of fuel injected into the combustion chambers of an internal combustion engine to improve operation of the engine under a wide range of conditions from engine idle to high power demand comprising a primary cam portion having a starting cam surface to provide a rapid rate of injection and a following cam surface to provide a slow rate of injection so that a first range of different pulse waves have a sharp and fast beginning and a slow end of injection to simulate the running of said followers off of the end of the cam thereby profiling said pulse waves for a range of low engine power demands with reduction in combustion noise and exhaust particulates, and further comprising an auxiliary cam portion operatively connected to and following the primary cam to provide a continued rapid rate of injection and to provide a cam section thereon for establishing points for quickly ending the injection of each pulse wave initiated on said primary cam to thereby vary and increase the volumes of said pulse waves for meeting varying high power demands.

5. A method of injecting pulses of fuel into the combustion chambers of an internal combustion engine at rates which vary in accordance with varying engine speeds and loads ranging from low engine speeds and loads to maximum engine speeds and loads to optimize engine performance while reducing emission particulate and NOx comprising the steps of:

a. providing a compound pumping cam with primary and auxiliary cams operatively connected by a transitional pumping ramp, b. moving a carrier and a movable follower means across said compound pumping cam to effect the movement of said follower to pump pulses of fuel into said combustion chambers, c. ending the injection of said fuel on said primary cam to provide a smooth end of injection for even burning and reduced particulate emission and noise for low engine load operations, and d. ending the injection of said fuel on said auxiliary cam to provide increased amounts of fuel for engine starting and for high load engine operation.

6. A method of rate shaping pulses of fuel injected into the combustion chambers of an internal combustion engine with relatively rotatable pumping plunger and cam mechanisms comprising the steps of:

(1) providing said cam mechanism with a plurality of serially arranged pumping surfaces, (2) relatively moving said pumping plunger mechanism and said cam so that the plunger mechanism follows the contour of the serially arranged pumping surface, (3) providing a first cam surface inclined with a slope to effect a high initial rate of fuel injection into at least one of said combustion chambers, (4) providing a second cam surface following the first cam surface with rate of injection less than the initial rate of injection so that the injection can be ended thereon to shape the pulse with a soft end of injection for low engine torque operation, (5) providing a cam ramp surface connected to said second camming surface to augment the first high rate of injection so that fuel pumping can be terminated after said pumping mechanism traverses at least a portion thereof to provide sufficient fuel for engine starting and for high torque operation of said engine.

7. A method of rate shaping pulses of fuel injected into the combustion chambers of an internal combustion engine with relatively rotatable pumping plunger and cam mechanisms comprising the steps of:

(1) providing the cam mechanism with a plurality of serially arranged pumping ramps, (2) relatively moving the pumping plunger and the cam mechanism so that the plunger mechanism follows the contour of the serially arranged pumping ramps to pump rate shaped pulses of fuel into said chambers, (3) providing a first of said ramps with a slope to effect a high initial rate of fuel injection into at least one of said chambers, (4) providing additional ramps following the first ramps with slopes to effect rates of fuel injection less than the initial rate of injection, (5) selectively and initially terminating the injection on said additional ramps to shape the fuel pulse with a soft end of injection for operating the engine under low loads conditions and with reduced noise and exhaust particulates, (6) providing an auxiliary ramps leading from and connected to said additional ramps to augment the quantities of fuel supplied to said chambers from said first and said additional ramps, and selectively terminating the fuel injection after said pumping mechanism traverses said first and said additional portion of said auxiliary ramps to provide increased quantities of fuel for engine starting and for high horsepower operations.

* * * * *